United States Patent [19]

Henning

[11] Patent Number: 4,560,116

[45] Date of Patent: Dec. 24, 1985

[54] AXIALLY TELESCOPIC COIL CARRIER PARALLEL TO EACH OTHER

[76] Inventor: Walter Henning, 1, Hermann-Lons-Strasse, Alsdorf-Hoengen, Fed. Rep. of Germany

[21] Appl. No.: 671,405

[22] Filed: Jun. 25, 1984

[30] Foreign Application Priority Data

Jun. 23, 1983 [DE] Fed. Rep. of Germany ... 8318224[U]

[51] Int. Cl.[4] ..... B65H 75/24

[52] U.S. Cl. ..... 242/118.11

[58] Field of Search ..... 242/118.1, 118.11, 118.2, 242/118.32

[56] References Cited

U.S. PATENT DOCUMENTS 1,367,934 2/1921 Winslow ..... 242/118.11

2,888,258 5/1959 Hoffstrom ..... 242/118.11

3,465,984 9/1969 Tigges et al. ..... 242/118.11

4,379,529 4/1983 Nielsen ..... 242/118.11

*Primary Examiner*—Stuart S. Levy

*Assistant Examiner*—Lloyd D. Doigan

*Attorney, Agent, or Firm*—Lalos, Keegan, Marsh, Bentzen & Kaye

[57] ABSTRACT

In an axially compressible lap carrier for taking up threads or yarns with parallel running elements (3, 10, 13), the latter are provided with axially protruding bulges (4, 14). When this lap carrier is in the compressed state, the bulges (4, 14) of adjoining ring elements (3, 10, 13) engage in each other. In the area of these bulges (4, 14) tie bars (7) are provided between the adjoining ring elements (3, 10, 13). These tie bars (7) are flexible and their outer edges are displaced radially inwards with respect to the winding surface (FIG. 1).

9 Claims, 10 Drawing Figures

Figure 1:
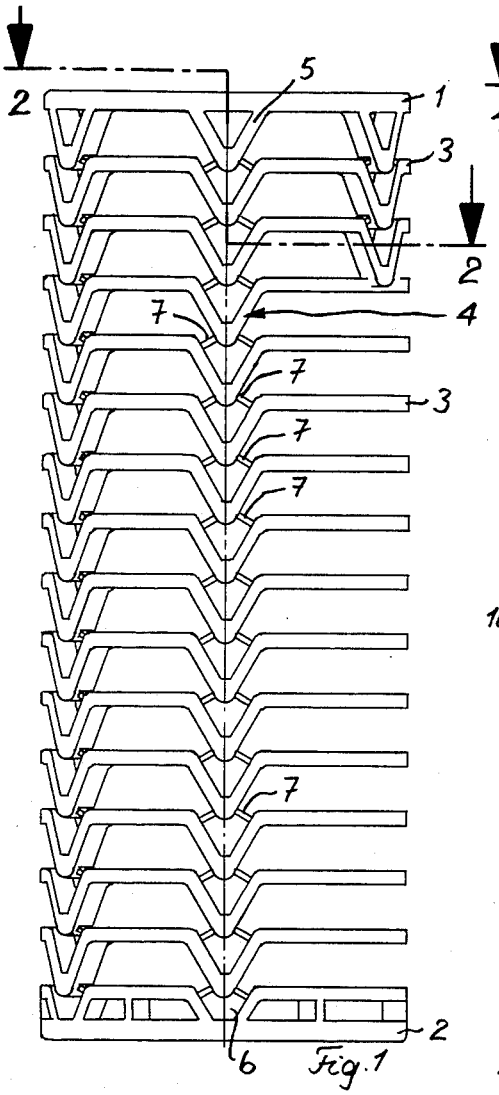

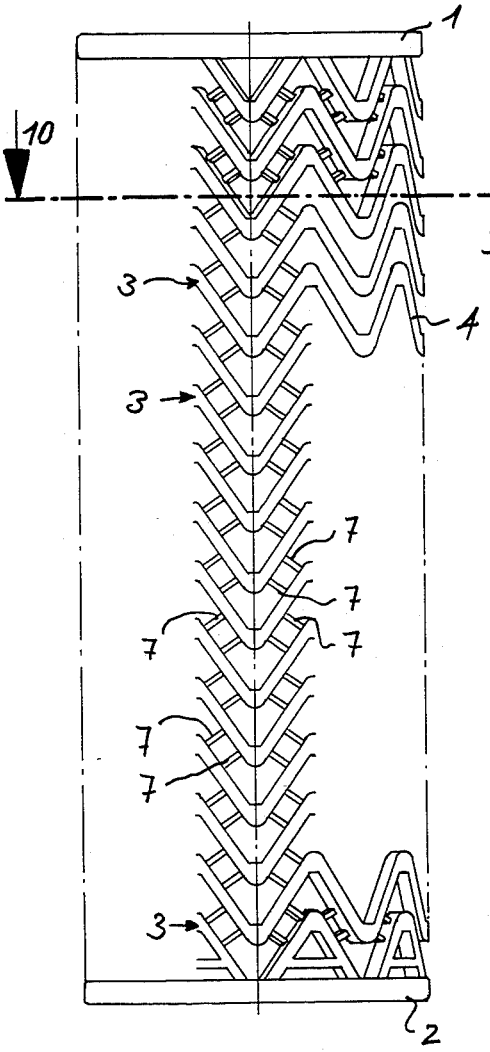
Fig. 8
Fig. 9
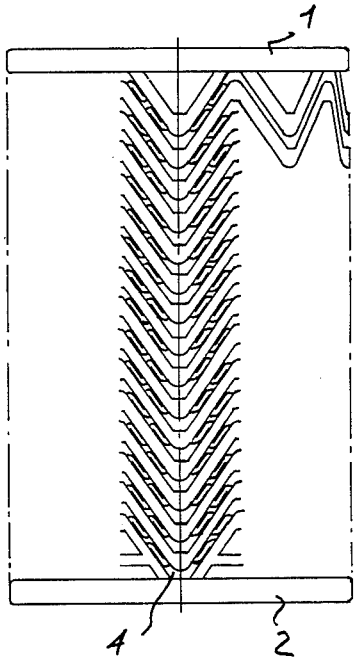
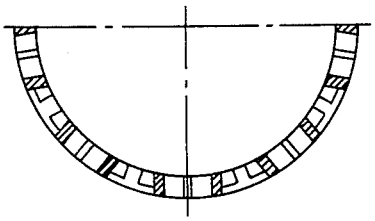
Fig. 10

AXIALLY TELESCOPIC COIL CARRIER PARALLEL TO EACH OTHER

DESCRIPTION

The invention relates to an axially compressible lap carrier for taking up threads or yarns, having ring elements that run parallel to one another, lie in a common cylindrical or conical winding surface, and are coupled to each other by deformable tie bars.

Axially compressible lap carriers for wet processing, particularly for the dyeing of threads or yarns, are known in the art, as exemplified by West German Pat. No. 881 490, and whose winding surface consists of a flat metal strip which is helically wound around the axis of the lap carrier and assumes the shape of a wave. Due to their construction, this type of lap carrier is more or less unstable, so that the danger exists that problems will arise when the loom is loaded at high speeds. Also, when they are compressed in axial direction, radial displacements of the individual threads in relation to one another may occur, which complicate the use of such a lap carrier.

Another danger is the fact that the inner windings of a yarn package enter the free space between adjoining threads of a screw and are thus nipped when the lap carrier is pressed in axial direction.

A lap carrier of the type mentioned above is also known and described in West German Pat. No. 1 635 084, which has generally proved its worth for the wet processing of threads and yarns. In this lap carrier, ring elements running parallel to one another are provided between end rings arranged on the free face and between which substantially axially running tie bars are placed. These tie bars form together with the ring elements the winding surface, on which the inner layers of a thread or yarn package come to rest. Thus, the inner windings of such packages rest on the ring elements as well as on the outer edges of the connecting elements that reach into the winding surface, whereby the individual ring elements must be visualized as rigid.

Due to the fact that with this prior art lap carrier the inner windings of the lap also lie directly on the tie bars which undergo a deformation during the compression and alter their distance to the adjoining ring elements, the inner yarn windings can be nipped between two sections of a connecting element or between a connecting element and an adjoining ring element. In this way, the inner windings are occasionally destroyed or they can no longer be reeled off.

Therefore, the major object of the present invention is to provide a lap carrier of the kind mentioned in the introduction, which overcomes the disadvantages of the prior art lap carriers and, in particular, prevents with a high degree of certainty the inner layers of a lap from being nipped.

This object is achieved in accordance with the teachings of the invention in that each ring element has at least two axially protruding bulges which are distributed over its periphery, each of which engages in corresponding bulges of at least one adjoining ring element, and that the tie bars flexibly connect adjoining ring elements in the area of the coacting bulges, run at an angle with respect to the axial direction of the lap carrier, and are displaced radially inwards with their outer edges relative to the winding surface.

In this way, it is assured that the winding surface is formed exclusively by substantially rigid ring elements and not by tie bars that inevitably must be subjected to a considerable deformation during the compression of the lap carrier. In the process, the tie bars are not shortened in axial direction, e.g., due to a folding together, but perform only a bending motion, thereby eliminating a prominent cause for the nipping of inner yarn layers. Furthermore, the interlocking of the bulges of adjoining ring elements in this area always results in a more or less heavily curved course of the free space in the area of the bulges so that here, too, the inner yarn layers are prevented from penetrating between the ring elements. The mounting of the tie bars between the ring elements in the area of the bulges further assures that the ring elements in the area of the bulges cannot be pressed directly against one another.

The bulges of a ring element can be joined directly to one another in the peripheral direction.

In addition, due to the mounting of at least two bulges in each ring element, the ring elements are not completely rigid in the manner desired. The ring elements can thus give way to a certain amount of residual shrinkage of the lap situated on the lap carrier. However, such a radial compression is possible only to a relatively small degree.

The lap carrier embodying the invention can further be so designed that the ring elements on the regions of transition to the bulges and/or in the bulges proper have bending places with a reduced cross section, thereby also simplifying the acceptance of a residual shrinkage.

The lap carrier incorporating the invention can also be designed in such a way that the bulges or the ring elements are formed in a substantially V configuration. In this case, the inclination of the limbs of the bulges can make allowance for the course of the inner yarn windings so as to ensure the greatest possible crossing angle between the limbs of the bulges and the inner yarn windings, so the inner yarn windings can be prevented from entering the free space in the area of the bulges.

The lap carrier taught by the invention can further be so designed that the individual bulges are stepped or corrugated. Thus, the rigidity or flexibility can also be influenced.

The lap carrier of the invention can also be designed such that the tie bars are arranged at an angle greater than 30 degrees in relation to the axial direction of the lap carrier. Especially in such an embodiment, it becomes evident that the whole lap carrier is compressed not by an axial shortening of the tie bars, but by a bending of these tie bars.

The lap carrier of the invention can further be so designed that the bulges of adjoining ring elements are flexibly coupled to each other by at least two tie bars.

The lap carrier of the invention can also be so designed that it has at least one end ring that forms bulges which engage in corresponding bulges of the adjoining ring elements, or which support said bulges.

The width, surface condition, and outside diameter of each end ring can thus be adapted to the particular requirements.

The lap carrier of the invention can further be so designed that at least one end ring forms a receptacle for a thread reserve.

Finally, the lap carrier taught by the invention can be so designed that it has at least one intermediate ring which forms bulges on either side that engage in corresponding bulges of the adjoining ring elements, or which support said bulges. The degree of radial stability can be fixed in the manner desired in each particular case by mounting such intermediate rings.

Figure 3:
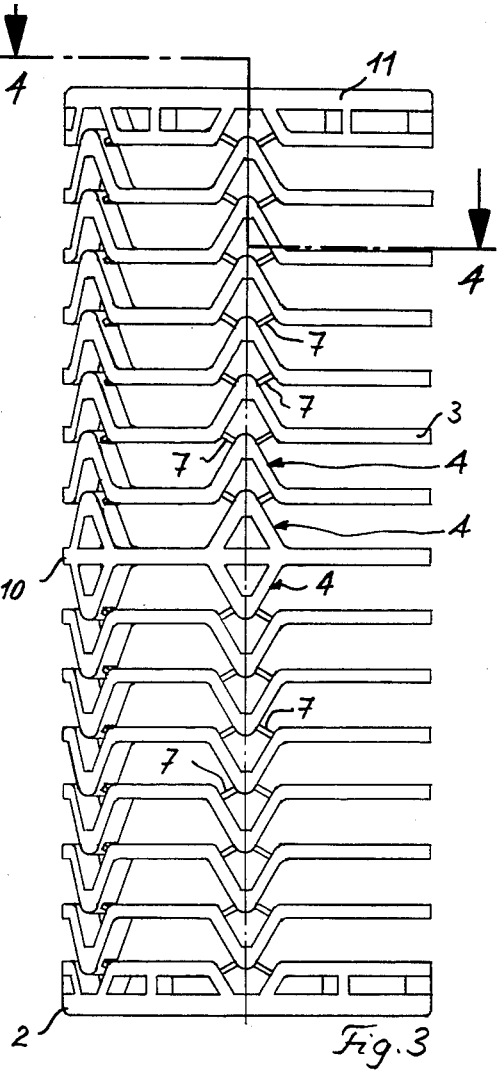
Figure 2:
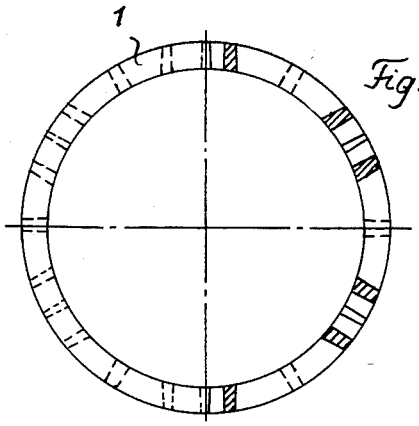
Figure 4:
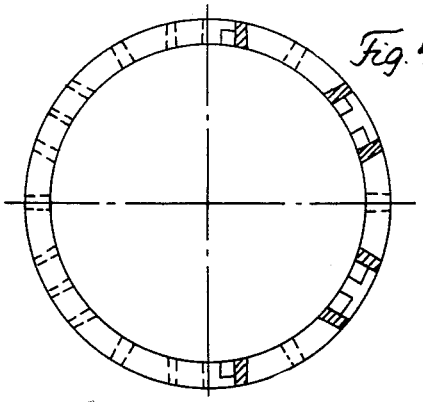
Figure 5:
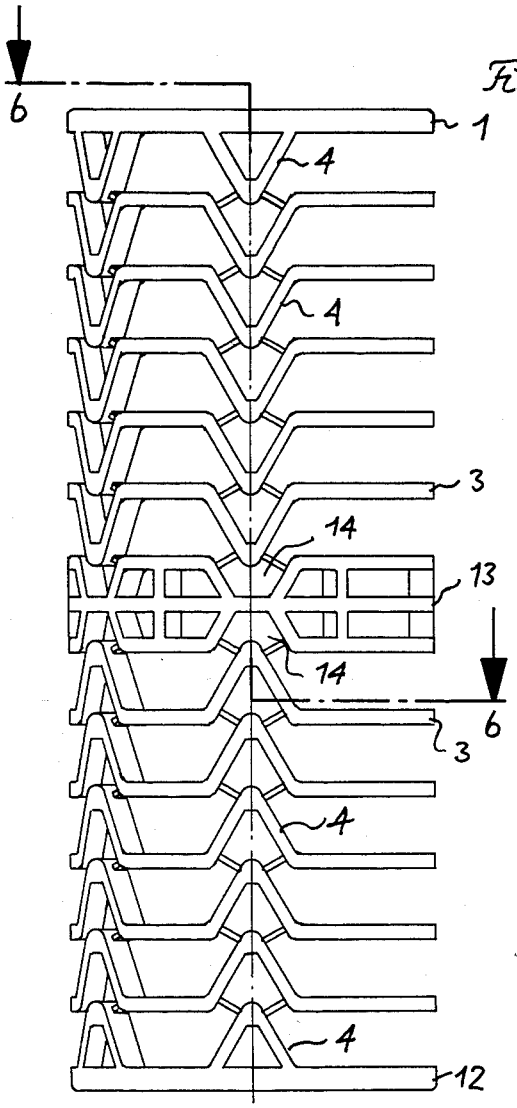
Figure 7:
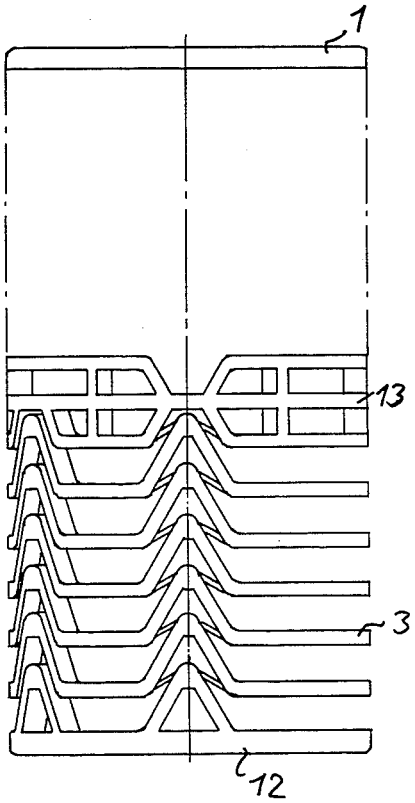
Figure 6:
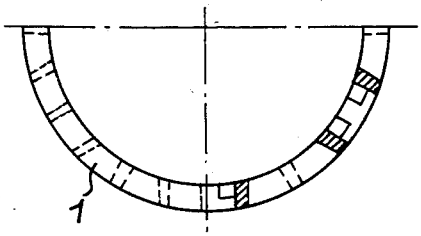

The invention will now be described with reference to an embodiment of the lap carrier of the invention in conjunction with the accompanying drawings, in which:

FIG. 1 is a side view of an embodiment of the lap carrier incorporating the invention, FIG. 2 is a partial sectional view taken along the line 2—2 in FIG. 1, FIG. 3 is a side view of a second embodiment of the lap carrier embodying the invention provided with an intermediate ring, FIG. 4 is a partial sectional view taken along the line 4—4 in FIG. 3, FIG. 5 is a side view of another embodiment of the lap carrier of the invention, FIG. 6 is a partial sectional view taken along the line 6—6 in FIG. 5, FIG. 7 is a side view similar to that of FIG. 5 depicting the lap carrier in an axially compressed state, FIG. 8 is a side view of another embodiment of the lap carrier of the invention, FIG. 9 is a side view of the lap carrier of FIG. 8 in an axially compressed state, and FIG. 10 is a partial sectional view taken along the line 10—10 in FIG. 8.

The lap carrier in the form of construction depicted in FIGS. 1 and 2 has an upper end ring 1 as well as a lower end ring 2. Between these end rings 1 and 2 are provided ring elements 3 which run parallel to one another and to the two end rings 1 and 2. In the embodiment shown, the ring elements are identical to each other. Their outside diameters correspond to those of the end rings 1 and 2. Each ring element is provided with a plurality of bulges 4, only one of which is shown in FIG. 1 for simplicity. These bulges 4 have a substantially V-shaped course, all running in the same direction. The bulges 4 of the ring elements 3 lie flush one behind the other, so the bulge of one ring element 3 can radially engage in a bulge of a ring element 3 that adjoins in axial direction.

Corresponding bulges 5 are fitted to the end ring 1, while the end ring 2 has corresponding bulges 6 in which can engage the bulges 4 of the adjoining ring element 3.

Due to its axial stretch, the end ring 2 is suited to accommodate a thread reserve.

The individual ring elements 3 are flexibly coupled to each other by tie bars 7 provided in the area of the bulges 4, whereby a tie bar 7 coacting with a limb of the axially adjoining bulge engages, on one of its sides, each limb of a bulge. The tie bars 7 run at an angle with respect to the axial direction of the lap carrier. Preferably, this inclination is approximately 30 degrees. Its outer edge is displaced radially inwards with respect to the winding surface. They are dimensioned such as to be correspondingly bent into one another during the axial compression of the lap carrier and, thereby, during the interlocking of the adjoining bulges 4.

The bulges 5, 6 of the end rings 1, 2 are connected by tie bars 7 to the adjoining ring elements 3 in the same manner the ring elements 3 are connected to one another.

As shown in FIG. 2, each ring element 3 is provided with six bulges 4 over its periphery. However, the number of these bulges may vary, depending upon the requirements in each particular case.

The embodiment of the lap carrier of the invention as depicted in FIGS. 3 and 4 will be discussed only with respect to the differences from the embodiment described earlier. This embodiment has an intermediate ring 10. The portion of this lap carrier between the lower end ring 2 and the intermediate ring 10 corresponds in its construction to the lap carrier illustrated in FIG. 1. However, the intermediate ring 10 has, on its two sides, bulges 4 which protrude axially in opposite directions. This means that in FIG. 3 the bulges 4 of the ring elements 3 point downwards below the intermediate ring 10 and upwards thereabove. The design of the lap carrier is symmetrical in relation to a plane extending through the intermediate ring 10. Therefore, in this embodiment, the upper end ring 11 has the same construction as the lower end ring 2.

The lap carrier depicted in FIGS. 5–7 is also symmetrical with respect to a plane extending through an intermediate ring 13. This means, first, that a lower ring 12 is provided which corresponds to the upper end ring 1. Each of the bulges 4 provided on the end rings 1 and 2 protrudes axially toward the intermediate ring 13 on either side thereof. This intermediate ring 13 has a certain axial stretch and has bulges 14 in which can engage the bulges 4 of the ring elements 3 adjoining the intermediate ring 13.

In FIG. 7, the lap carrier shown in FIG. 5 is depicted in an axially compressed state, but only the lower portion thereof is shown in detail.

The lap carrier depicted in FIGS. 8–10 has ring elements 3 in which the bulges 4 are joined directly to one another. Bulge 4 of a ring element engages in a corresponding bulge 4 of an adjoining ring element 3. Two such bulges 4 are flexibly coupled to one another by a total of four tie bars 7, two of which lie on each side of the bulge 4 and run substantially parallel to each other. In this embodiment, too, the tie bars 7 are displaced radially inwards with respect to the winding surface.

Plastic material is of particular, though not exclusive, interest for the fabrication of this lap carrier.

The lap carrier can also be designed in such a way that its resistance to axial and/or radial compression varies throughout the height of the lap.

I claim:

1. Axially compressible lap carrier for taking up threads or yarns comprising: parallel ring elements lying in a common cylindrical or conical winding surface and coupled to one another by deformable tie bars, each ring element having at least two axially protruding bulges distributed over its periphery, each bulge nesting in corresponding bulges of at least one adjoining ring element and the tie bars flexibly connecting the nesting bulges of adjoining ring elements, running at an angle with respect to the axial direction of the lap carrier and displaced radially inwards in relation to the winding surface.

2. The lap carrier as set forth in claim 1, wherein the ring elements on the region of transition to the bulges have bending places with a reduced cross section.

3. The lap carrier as set forth in claim 1 wherein the bulges of the ring elements are designed in a substantially V configuration.

4. The lap carrier as set forth in claims 1, 2, or 3, wherein the individual bulges are stepped.

5. The lap carrier as set forth in claims 1, 2 or 3, wherein the tie bars are arranged at an angle of more than 30 degrees with respect to the axial direction of the lap carrier.

6. The lap carrier as set forth in claims 1, 2 or 3, wherein the bulges of adjoining ring elements are flexibly coupled to one another by at least two tie bars.

7. The lap carrier as set forth in claims 1, 2 or 3, wherein carrier has at least one end ring which forms bulges that engage in corresponding bulges of the adjoining ring element.

8. The lap carrier as set forth in claim 7, wherein at least one end ring forms a receptacle for a thread reserve.

9. The lap carrier as set forth in claims 1, 2 or 3, wherein it has at least one intermediate ring which forms bulges on either side that engage in corresponding bulges of the adjoining elements.

* * * * *